US005163190A

United States Patent [19]

Hwang

[11] Patent Number: 5,163,190

[45] Date of Patent: Nov. 17, 1992

[54] MULTIPURPOSE BUILT-UP CRIB

[76] Inventor: Tsong-Ching Hwang, No. 54-5, Sec. 1, Hsin Sheng S. Road, Taipei, Taiwan

[21] Appl. No.: 549,052

[22] Filed: Jul. 6, 1990

[51] Int. Cl.[5] ..... A47D 7/00

[52] U.S. Cl. ..... 5/93.2; 5/183; 5/285

[58] Field of Search ..... 5/93.1, 93.2, 100, 181, 5/175, 178, 183, 184, 2.1, 285

[56] References Cited

U.S. PATENT DOCUMENTS

| | | | |
|---|---|---|---|
| 318,111 | 5/1885 | Healey | 5/93.1 |
| 1,175,673 | 3/1916 | Anderson | 5/100 |
| 2,620,492 | 12/1952 | MacNeny | 5/181 |
| 2,677,832 | 5/1954 | Christensen | 5/93.1 |
| 3,002,199 | 10/1961 | Galloway | 5/93.1 |
| 3,225,364 | 12/1965 | Miret | 5/93.1 |
| 3,299,450 | 6/1967 | Gottfried | 5/100 |
| 3,896,513 | 7/1975 | Boucher | 5/100 |

FOREIGN PATENT DOCUMENTS

| | | | |
|---|---|---|---|
| 587777 | 4/1925 | France | 5/93.1 |
| 180522 | 6/1922 | United Kingdom | 5/93.1 |

*Primary Examiner*—Rodney M. Lindsey
*Assistant Examiner*—F. Saether

[57] ABSTRACT

An expandable bedstead comprises a horizontal base frame having a vertical headboard frame fixedly connected to a first side thereof, a pair of leg supports fixedly connected to the corner portions of an opposing second side of the base frame, a vertical footboard frame pivotably connected to the leg supports, a vertical left side frame having an upper and lower subframes releasably connected to the left side of the base frame, and a vertical right side frame releasably connected to the right side of the base frame and to the headboard and footboard frame. The bedstead can be expanded lengthwise by first disconnecting the right side frame and then pivoting the footboard frame into horizontal alignment with the base frame, afterwhich the detached right side frame is connected to the rear side of the reclined footboard frame to define a new footboard and the upper subframe is detached from the headboard and lower subframe to which it is connected and re-attached to the vacant right lateral side of the base frame so as to define a pair of side gates. The subframes can alternately be detached from the bedstead to remove the side gates.

1 Claim, 4 Drawing Sheets

MULTIPURPOSE BUILT-UP CRIB

BACKGROUND OF THE PRESENT INVENTION

The present invention relates to an expandable bedstead and more particularly to an expandable bedstead having adjustable dimensions that can accomodate users of widely varying physical size such as infants, children, or adults.

More conventional bed structures that are designed for infants and young children such as cribs and the like are quickly outgrown by a user as he or she matures physically. As a result, the bed is usually discarded, or collapsed and stored should it's structure allow, once it's fixed dimensions can no longer accomodate the user, with a growing child usually working through a number of beds before he or she matures into an adult.

It was in light of this shortcoming of the more conventional bed structures that the present invention was accomplished so as to provide a bed structure whose size can be adjusted to accomodate users from all age groups.

SUMMARY OF THE PRESENT INVENTION

In accordance with the present invention, an expandable bedstead structure comprises a horizontal base frame having a vertical headboard frame releasably secured to a first longitudinal side thereof, a vertical footboard frame pivotably connected to a pair of support legs fixed to a second longitudinal side of the base frame, a vertical left side frame comprising two subframes releasably connected over the corresponding lateral side of the base frame, and a vertical right side board releasably connected to the other lateral side thereof. Wherein, the bedstead structure can be expanded to increase its length by first disconnecting the right side frame which is also releasably secured to the headboard and footboard frames and then pivoting the footboard frame into horizontal alignment with the base frame, afterwhich the detached right side frame is connected to the rear side of the reclined footboard frame to define a new footboard and the upper subframe is detached from the headboard and lower subframe to which it is connected and reattached to the vacant right lateral side of the base frame so as to define a pair of side gates. Alternately, both subframes can be detached from the bedstead structure sans the side gates.

It is thus a main object of the present invention to provide a bedstead structure as characterized which can be expanded so as to be able to accomodate users of varying physical size. A further object of the present invention is to provide a bedstead structure that can accomodate a user as he or she matures from an infant to an adult.

A more thorough understanding of the present will be obtained by reference to a detailed description of a preferred embodiment thereof provided below along with accompanying drawings.

BRIEF DESCRIPTION OF THE DRAWINGS

FIG. 1-1 is a close-up view showing the connection between a leg support and a base frame and footboard frame of the bedstead.

FIG. 1-2 is a close-up view showing a hinged connection between an upper frame of a left side frame of the bedstead and and a lower frame thereof.

FIG. 1-3 is a close-up view showing a bolt and staple connection between the upper frame of the left side frame of the bedstead and corresponding portion of the footboard frame thereof. FIG. 1-4 is a close-up view showing a threaded rod connection between a right side frame of the bedstead and the footboard frame thereof.

FIG. 2 is a perspective exploded view of the bedstead structure of FIG. 1.

FIG. 3 is a perspective view showing the bedstead structure in it's expanded form.

FIG. 4 is a perspective view showing the bedstead structure of FIG. 3 with the side gates thereon removed.

DETAILED DESCRIPTION OF THE PREFERRED EMBODIMENTS

Figure 1:
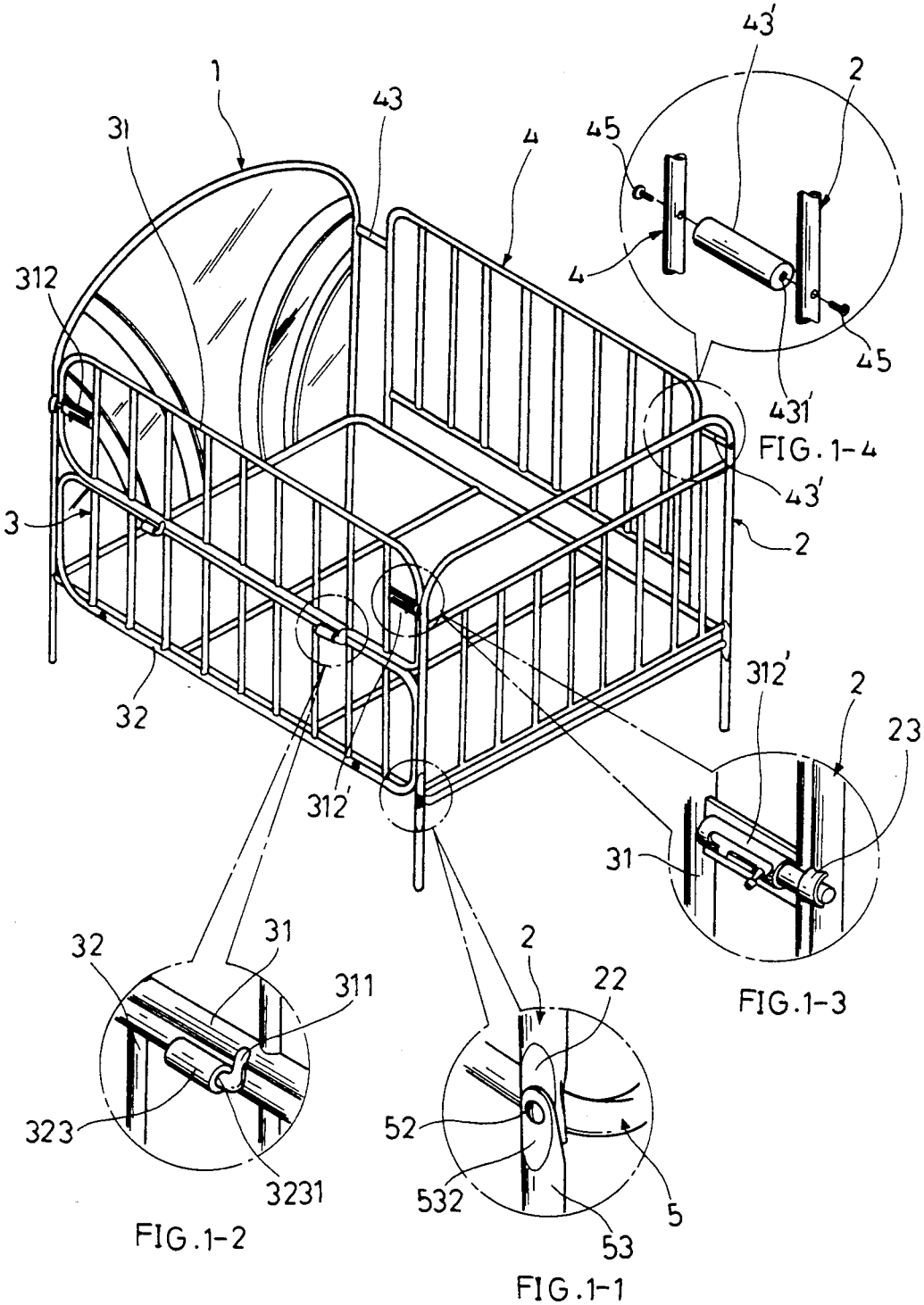
FIG. 1 is a perspective view showing an assembled bedstead structure of the present invention in it's most compact form.
Figure 2:
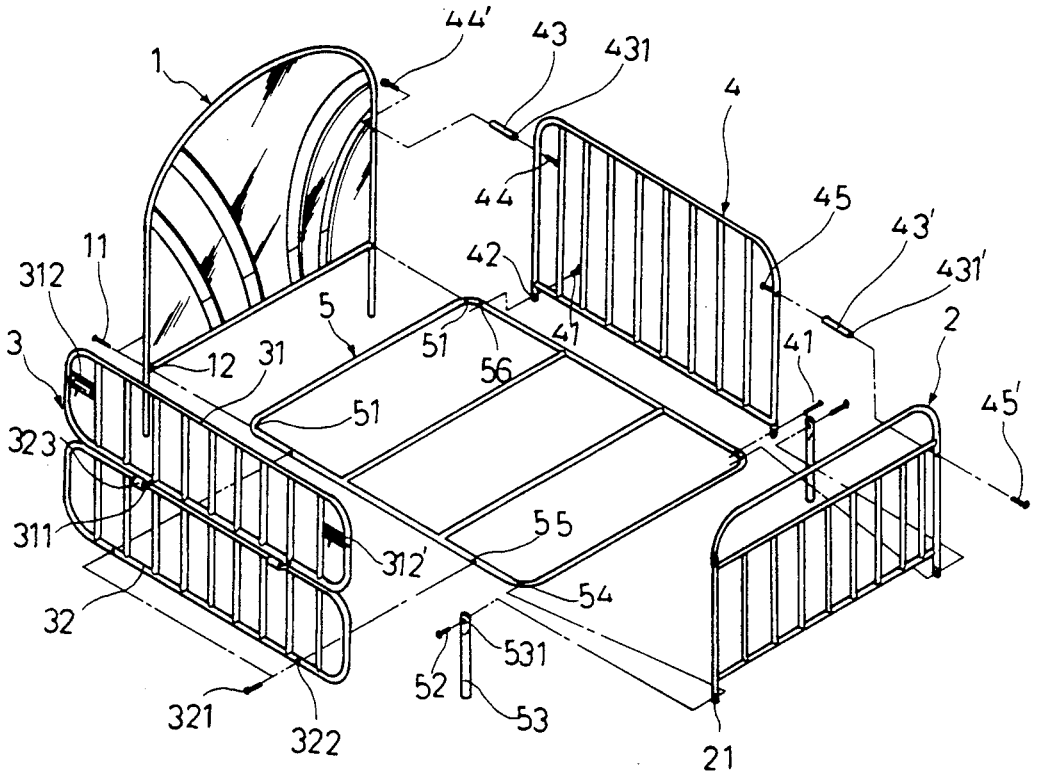

Referring to FIGS. 1 and 2 of the drawings, the bedstead structure of the present invention comprises an elevated horizontal base frame 5 which is supported by a vertical headboard frame 1 releasably secured therewith along a first longitudinal side and a pair of leg supports 53 fixedly connected to the corner portions of the second longitudinal side thereof, a vertical footboard frame 2 which is pivotably connected to the leg supports, a vertical left side frame 3 comprising a lower subframe 32 releasably connected to the corresponding lateral side of the base frame and an upper subframe 31 releasably attached over subframe 32 between the headboard and footboard frames, and a vertical right side frame 4 releasably connected to the opposite lateral side of the base frame and with the headboard and footboard frames.

Figure 3:
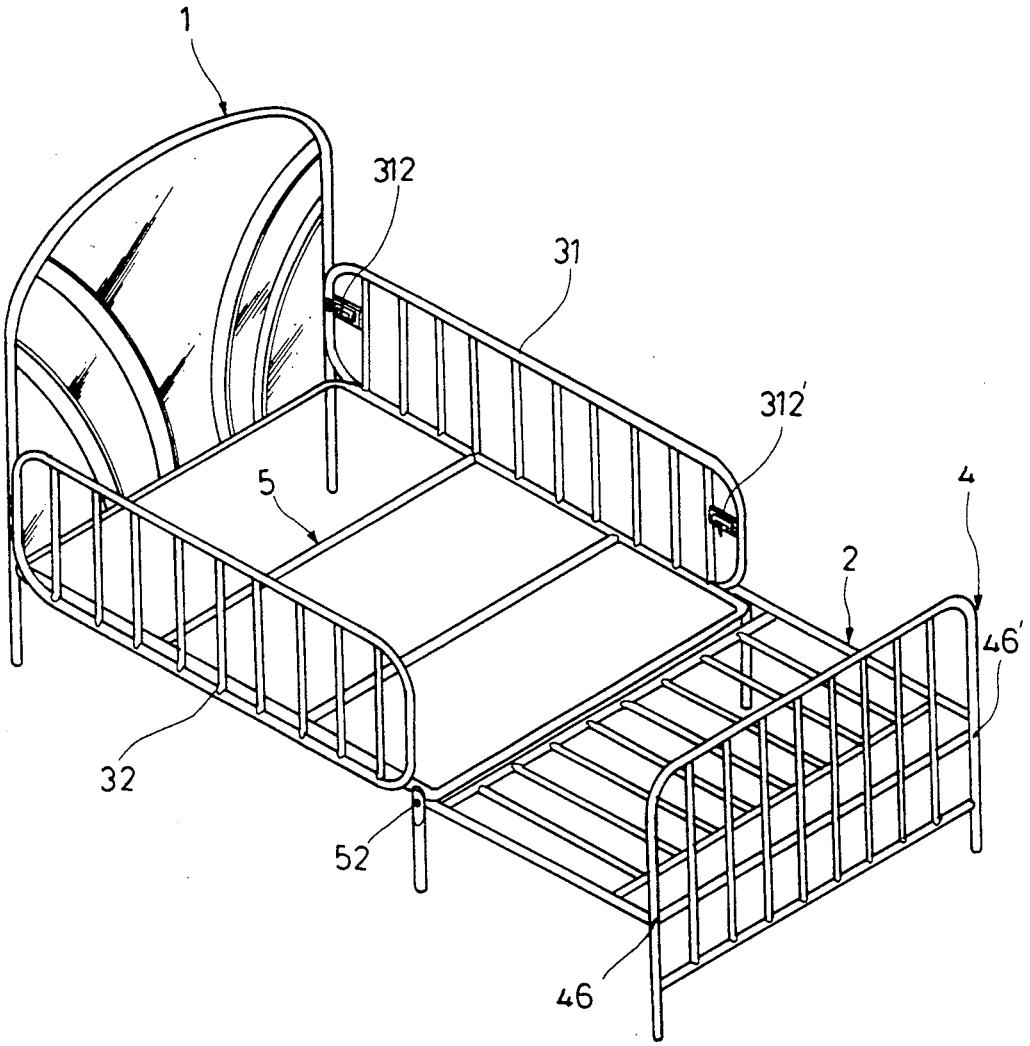
Figure 4:
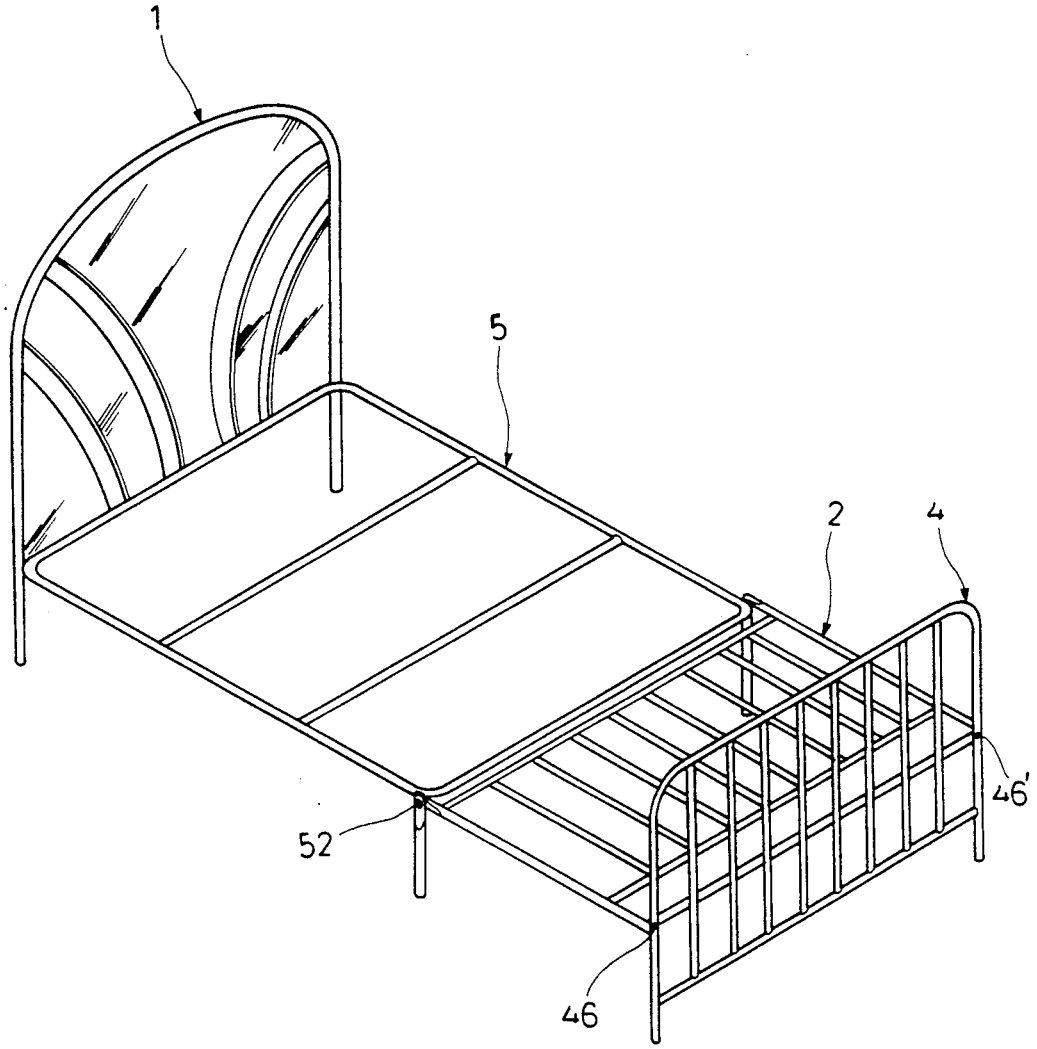

The headboard frame 1 is secured to the front of the base frame 5 by a pair of threaded fasteners 11 which pass through respective holes 12 formed above a pair of leg supports of frame 1 and engage aligned holes 51 on the corner portions of the front side of the base frame. Each leg support 53 is similarly secured to the rear of base frame 5 by a threaded fastener 52 which engages threaded holes 531 and 54 formed on the upper end of the support 53 and a corresponding side corner portion on the rear side of the base frame. Fasteners 52 also pass through holes 21 formed on respective lower descending portions of footboard frame 2 so as to pivotably connect frame 2 to the rear of the base frame. As shown in FIG. 1-1, both the descenders of the footboard frame and the leg supports 53 have cooperatingly beveled adjoining ends 22 and 532 that enable the rotational displacement of footboard frame 2 into an aligned horizontal position with respect to base board 5. Lower subframe 32 is releasably secured to the left lateral side of frame 5 by a pair of threaded fasteners 321 which pass through holes 322 on the lower portion of the subframe and engage corresponding holes 55 on the left side of the base frame. Upper subframe 31 is releasably attached above subframe 32 by a pair of hinge pins 311 provided on the lower side thereof which engage cooperating elongate lugs 323 on the upper side of the lower subframe having bores 3231 formed therein, as shown in FIG. 1-2. Subframe 31 is held in a vertical position by a pair of retractable bolts 312,312' that are engagable with staples provided on the left sides of frame 1 and frame 2. FIG. 1-3 shows the rear bolt 312' of subframe 31 engaged with the staple 23 of the footboard frame. The right side frame is releasably connected to frame 5 by threaded fasteners 41 which pass through respective holes 42 on a lower portion thereof to engage corresponding holes 56 on the right side of the base frame. Frame 4 is also releasably connected to headboard frame 1 by fasteners 44,44' which pass through respective holes on adjacent side portions of frames 4 and 1 and are engaged via an elongate connector rod 43 having a threaded cavity 431. Footboard frame 2 is likewise connected with frame 4 by fasteners 45,45' and connector rod 43' with the fasteners passing through respective holes on the rights side frame and footboard frame to engage with cavity 431' in the connector rod, as shown in FIG. 1-4. The bedstead structure as assembled is thus suitable for use by infants or young children.

The bedstead can be expanded or lengthened to accomodate adolescents or adults as follows. The right side frame 4 is first disconnected from the bedstead structure by removing fasteners 41,42 and 44,44' and 45,45' and footboard frame 2 is rotated rearwards into horizontal alignment with the base frame 5. Frame 4 is then connected in a vertical alignment to the rear side of the reclined footboard frame by a pair of fasteners 46 and 46' engaged therewith through respective side portions of frame 4. Afterwhich upper subframe 31 can be removed from the lower subframe by sliding hinge pins 311 out from respective lugs 323 and similarly connected to the right side of the base frame with bolt 312 thereon moved into engagement with a staple provided on the right side of the headboard frame. Alternately, both upper subframe 31 and lower subframe 32 can detached from the bedstead structure, with the latter being removed by disconnecting fasteners 321, so as to form a bed structure sans the side gates defined thereby.

Though the above description contains many specificities these should not be construed as limitations inherent to the present invention, many variations and modifications thereto could readily be accomplished by a person skilled in the art, and as such the spirit and scope of the present invention should not be interpreted from the aforedescribed preferred embodiment but instead be determined from the appended claim and their legal equivalents.

I claim:

1. An expandable bedstead structure comprising:

a horizontal base frame having a first and second longitudinal sides and a first and second lateral sides;

a vertical headboard frame and at least one threaded fastener releasably securing said headboard frame to the first longitudinal side of said base frame;

a pair of leg supports and respective threaded fasteners releasably securing said leg supports to said base frame on the second longitudinal side thereof;

a vertical footboard frame pivotably secured to said leg supports by said fasteners securing said leg supports to said base frame;

a vertical lower subframe and at least one threaded fastener releasably connecting said lower subframe to the first lateral side of said base frame;

at least one elongate lug having a bore formed therein provided on an upper portion of said lower subframe;

a vertical upper subframe disposed over said lower subframe and having at least one hinge pin provided on a lower portion thereof, each said hinge pin being engagable in the bore of a corresponding said lug;

a first and second retractable bolts provided on said upper subframe and a first and second staples provided respectively on said headboard frame and said footboard frame, said first and second bolts being engagable with respective said first and second staples;

a vertical side frame and at least one threaded fastener releasably connecting said side frame to the second lateral side of said base frame;

first and second connector rods each having a threaded cavity and a first and second pair of threaded fasteners, said first pair of threaded fasteners releasably connecting said side frame to said headboard frame via said first connector rod and said second pair of threaded fasteners releasably connecting said side frame to said footboard frame via said second connector rod;

at least one threaded fastener for releasably securing said side frame to said footboard frame;

whereby, said footboard frame can be rotated into a parallel horizontal orientation with respect to said base frame and said side frame can be detached therefrom and connected to said footboard frame by one of said fasteners, and said upper subframe can be detached from said lower subframe and connected to the second lateral side of said base frame, or both said subframes can removed from said bedstead structure.

* * * * *